United States Patent [19]

Meadows

[11] Patent Number: 5,074,093

[45] Date of Patent: Dec. 24, 1991

[54] OVERLAPPING ARCHITECTURAL TILES

[76] Inventor: David F. Meadows, Rte. 3, Box 51, Milton, W. Va. 22541

[21] Appl. No.: 532,794

[22] Filed: Jun. 4, 1990

Related U.S. Application Data

[63] Continuation-in-part of Ser. No. 148,608, Jan. 26, 1988, Pat. No. 4,930,282.

[51] Int. Cl.[5] ..... E04D 1/34

[52] U.S. Cl. ..... 52/537; 52/520; 52/533; 52/531

[58] Field of Search ..... 52/570, 574, 579, 584, 52/588, 593, 793, 511, 550, 551, 522, 553, 521, 547, 537, 531

[56] References Cited

U.S. PATENT DOCUMENTS

| | | | |
|---|---|---|---|
| 544,303 | 8/1895 | Hoffelt | 52/550 X |
| 1,370,716 | 3/1921 | Tromm | 52/550 X |
| 2,419,005 | 4/1947 | Bochot | 52/550 X |
| 2,918,151 | 12/1959 | Kennedy | 52/588 |
| 3,852,933 | 12/1974 | Guzzo | 52/537 |
| 4,096,679 | 6/1978 | Haz | 52/537 |
| 4,133,161 | 1/1979 | Lester | 52/537 |
| 4,314,433 | 2/1982 | Hulcombe | 52/521 |

*Primary Examiner*—Richard E. Chilcot, Jr.
*Assistant Examiner*—Wynn Wood
*Attorney, Agent, or Firm*—Dickinson, Wright, Moon, Van Dusen & Freeman

[57] ABSTRACT

An architectural tile is made of a panel capable of overlapping a laterally adjacent panel as well as a longitudinally adjacent panel. The panels include a first part for being secured to a wall or roof and which includes a locking ridge for engaging a second part of an overlapping panel. The locking ridge terminates below the upper edge of the panel to allow a longitudinal overlap of the panels.

16 Claims, 4 Drawing Sheets

OVERLAPPING ARCHITECTURAL TILES

CROSS REFERENCE TO RELATED APPLICATION

This is a continuation in part of U.S. application Ser. No. 07/148,608, filed Jan. 26, 1988, now U.S. Pat. No. 4,930,282, the disclosure of which is incorporated herein by reference.

TECHNICAL FIELD

This invention relates to the field of architectural tiles. In particular, the invention relates to tiles formed of plastic and configured to permit overlap of the tiles to create the appearance of clay tiles or other materials such as cedar-shake shingles.

BACKGROUND ART

Clay tiles are well known, and an example of such is shown in U.S. Pat. No. 478,171 (Rapp). It is also known to simulate clay tiles with metal panels, an example of such being shown in U.S. Pat. No. 626,006 (Heidt).

Panels designed to be attached to each other and used primarily as walls are shown in U.S. Pat. Nos. 3,191,724 (Ridder), 3,289,375 (Cline), and 3,992,839 (LaBorde).

SUMMARY OF THE INVENTION

In accordance with the invention, an extruded plastic panel comprises a first longitudinally extending part for being secured to a surface of a structure, such as a roof or a wall. A second part of the panel extends laterally from the first part and is shaped to engage the first part of a laterally adjacent panel. The two parts are shaped to provide a desired appearance, for example, that of a clay tile. The first part of the panel preferably includes a flat surface and has an upward extending locking ridge for engaging attachment elements on the second part of a laterally adjacent panel. The locking ridge terminates below the upper end of the first part to permit a longitudinally adjacent panel to overlap it in the longitudinal direction. The locking ridge also forms a channel to direct water along the length of the panel.

The attachment elements of the second part of the panel terminate a distance spaced from the lower end of the panel. This allows the attachment elements to engage the locking ridge of a laterally adjacent panel while also permitting overlap of the second part of a longitudinally adjacent panel.

Each of the locking ridge and the attachment element preferably include two projections, or barbs, to ensure engagement between the attachment element an the locking ridge.

DETAILED DESCRIPTION OF THE DRAWINGS

Figure 1:
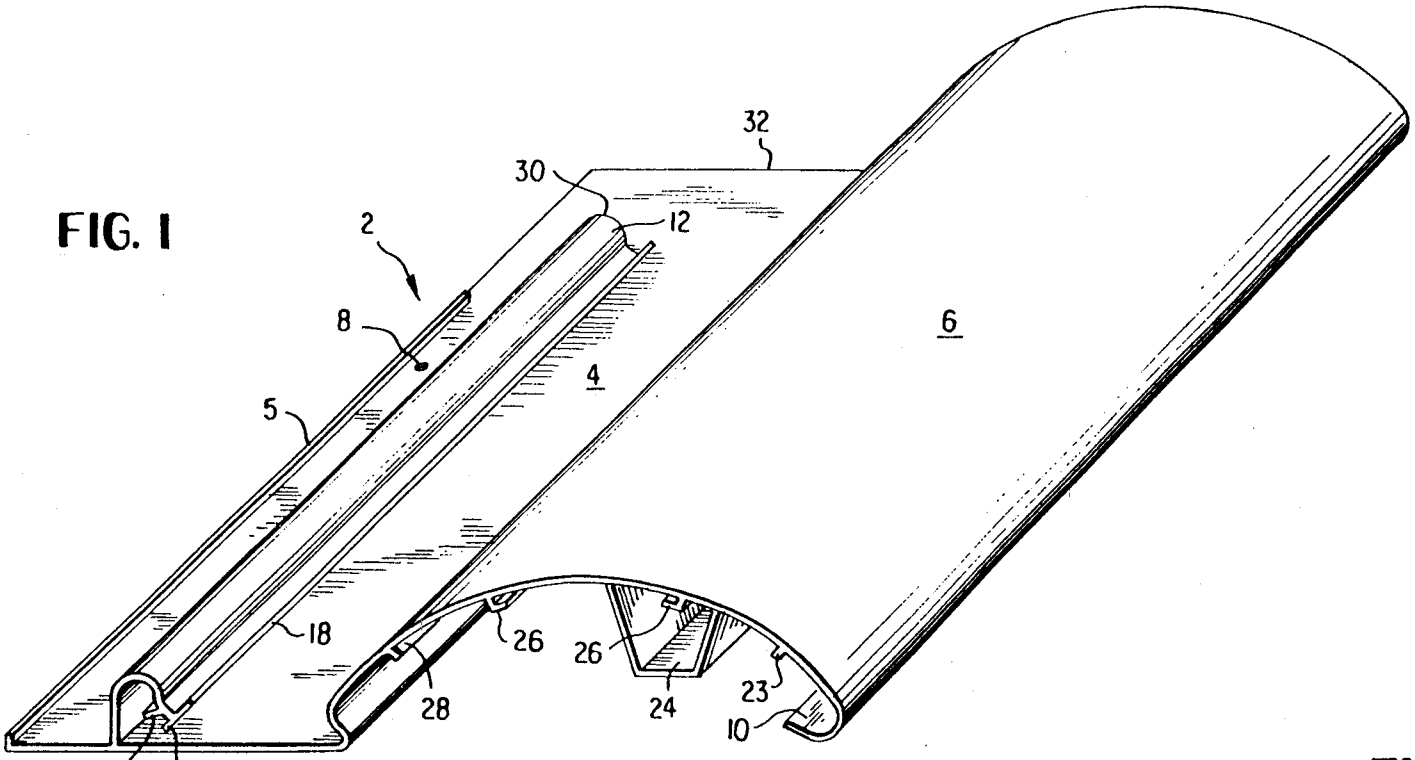
FIG. 1 is a perspective view of a panel in accordance with the invention.
Figure 2:
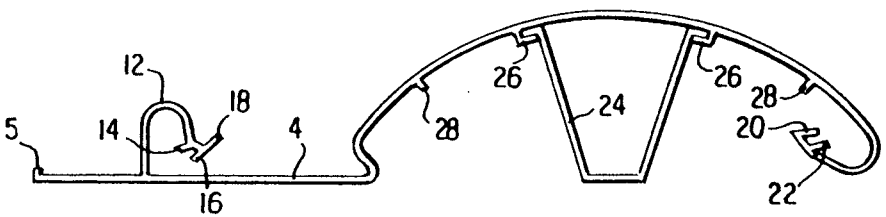
FIG. 2 an end view of the panel shown in FIG. 1.

With reference to FIG. 1, an architectural tile in accordance with the invention comprises a panel 2 having a first part 4 and a laterally adjacent second part 6. The first part is preferably flat for engaging the surface of a roof or wall and may include one or more holes, such as that shown at 8, for receiving a nail (not shown) for securing the panel to the roof or wall. The side edge 5 of the first part is raised slightly to provide strength and to form a channel to direct any condensation along the channel. The edge is flat in the region of overlap, however.

The first and second parts are configured to give a desired appearance. For example, in the preferred embodiment, the panel is configured to give the appearance of a clay tile. It may however, be configured to give the appearance of other types of shingles, such as cedar shake shingles, or entirely new designs.

The second part includes a lip 10 which engages one or more other panels as will be described below to hold the panel 2 to those other panels. The first part 4 includes a locking ridge 12 which extends upward from the first part for engaging a lip 10 from adjacent panels. Locking ridge 12 includes two projections 14 and 16 for engaging the lip 10 of the other panels and a third projection 18 for engaging the bottom of the second part of the other panels. The lip 10 has projections 20 and 22 which engage projections 14 and 16 of an overlying panel.

A V-shaped support 24 is held to the bottom of the second part by engagement with guides 26. The support extends between the wall or roof and supports the center of the second part of the panel. The support may also be secured to the wall or roof by nailing, cementing, or the like. The support 24 is removably received in the guides 26 and may be dispensed with in those instances where the additional strength provided by the support is not required.

Ribs 28 protrude from the bottom of the second part to space it from the upper surface of an overlapped panel to create a shadow line. The length of the support 24 is less than the length of a panel to permit longitudinal overlap of the panels, while the guides may extend the entire length of the panel to space the overlapped panel from the overlapping panel in the same manner as the ribs to create the shadow line. The distance by which the ribs 28 protrude from the bottom surface of a panel is substantially equal to that by which the guides protrude so that the depth of the shadow is constant.

Figure 3:
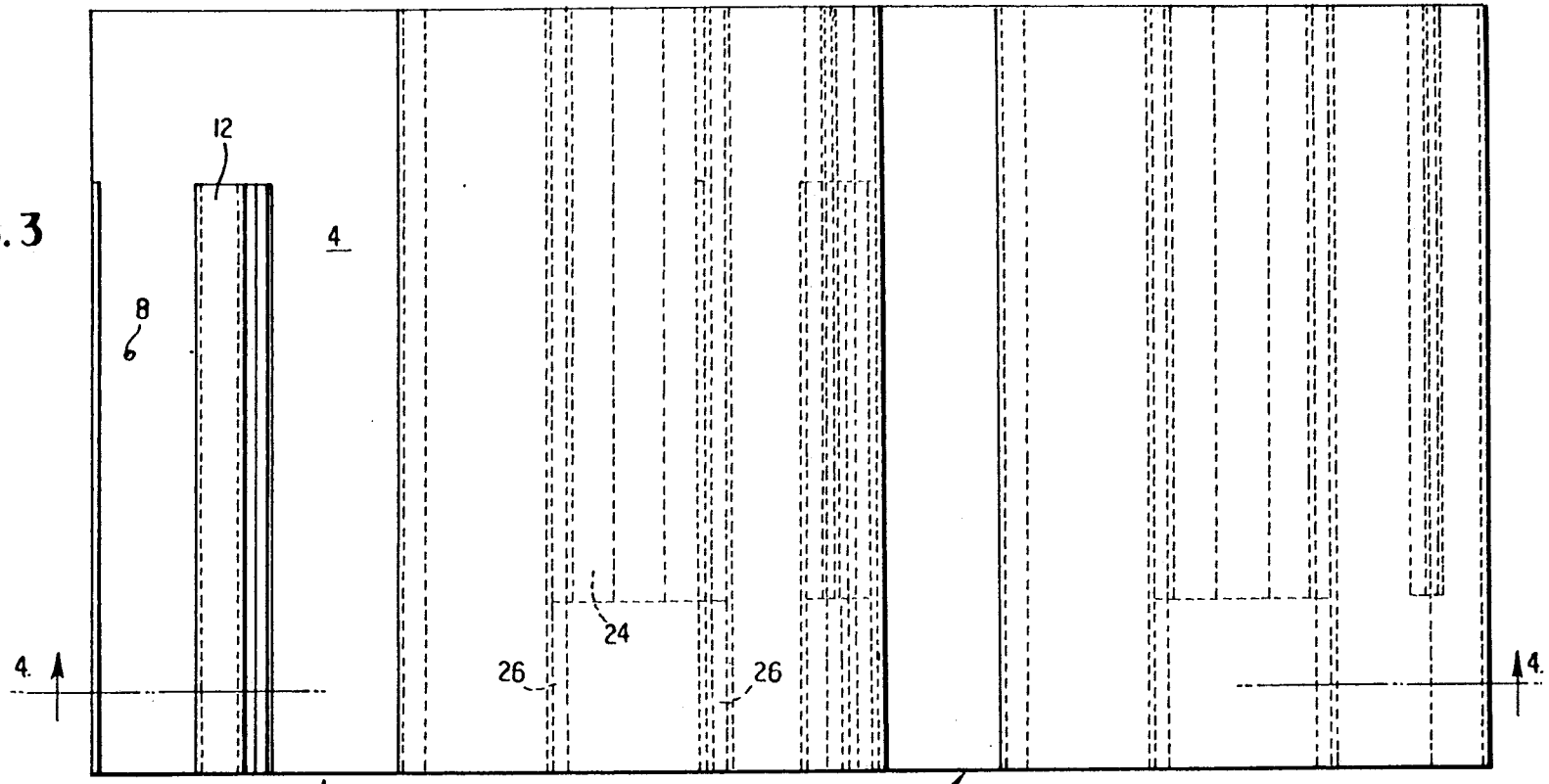
FIG. 3 is a top view of two laterally adjacent panels.
Figure 4:
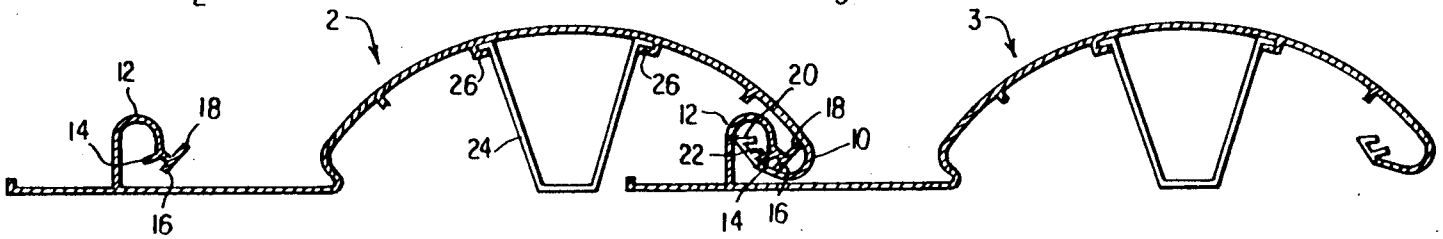
FIG. 4 is a cross section along line 4—4 of FIG. 3.

FIG. 3 is a top view of laterally adjacent panels 2 and 3, and FIG. 4 is a transverse cross section illustrating how these panels are connected together. Corresponding parts of the panels 2 and 3 have been given the same reference numbers. FIG. 4 shows how the lip 10 extends over the locking ridge 12 such that projections 20 and 22 engage projections 14 and 16. By using two sets of projections on both the locking ridge and the lip, engagement is assured even if the two parts are not in the complete engagement shown in FIG. 4. It will be appreciated that the parts will still be held together if projection 20 engages either of the projections 14 or 16.

Figure 5:
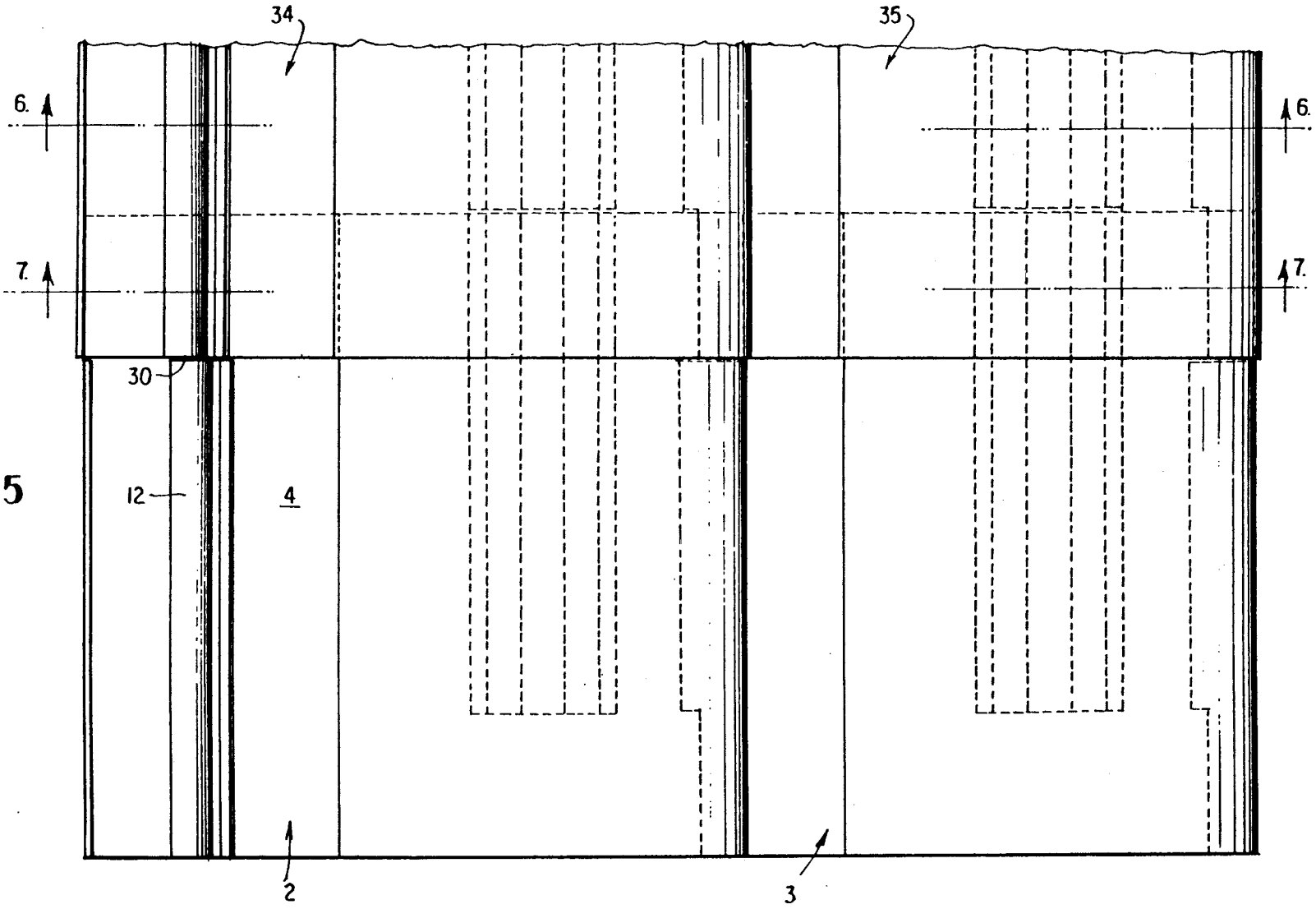
FIG. 5 is a top view of a first set of two laterally adjacent panels overlapping a second set of laterally adjacent panels in the longitudinal direction.
Figure 6:
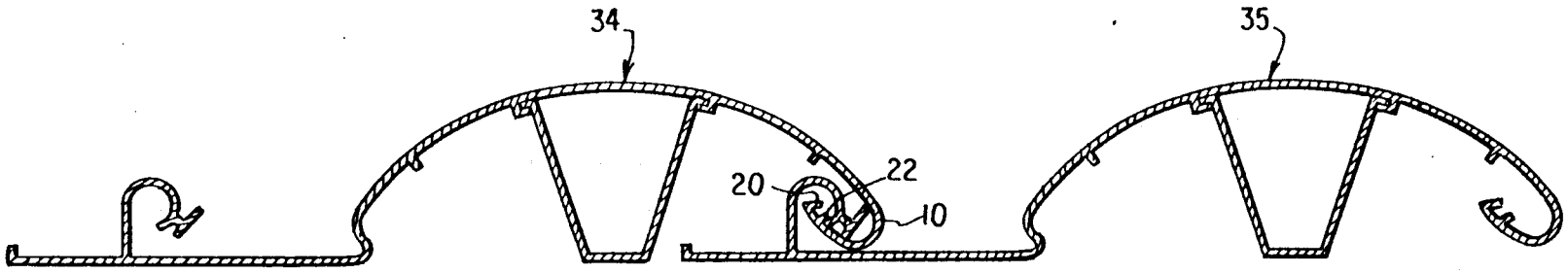
FIG. 6 is a cross section taken along line 6—6 of FIG. 5.
Figure 7:
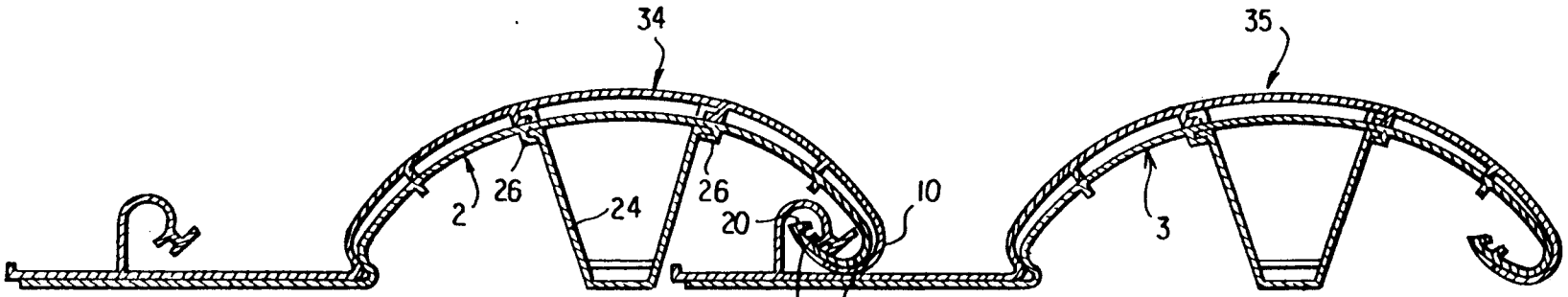
FIG. 7 is a cross section taken along line 7—7 of FIG. 5.

FIGS. 5 through 7 illustrate an overlapping engagement between two sets of laterally engaged panels 2, 3, 34, and 35. The upper end 30 of the locking ridge 12 is spaced from the upper edge 32 of the panel so that the lower edge of an overlapping panel 34 overlaps the first part 4 of the panel 2 in the space between the upper end 30 of the locking ridge and the upper edge 32 of the panel 2.

The overlapping panel 34 is displaced slightly laterally in the region of overlap as illustrated in FIGS. 5 and 7. The panels are preferably made of a somewhat flexible plastic, however, and the panels become aligned again in the region which is removed from the overlap, as shown by FIG. 6.

FIG. 7 illustrates how the lip 10 of overlapping panel 34 engages the lip 10 of the overlapped panel 4. Preferably, the projections 20 and 22 are not provided in the overlapping region of the second part, and the lower end of these projections is spaced from the lower end of the overlapping panel 34 by at least the distance of the overlap.

The panels are preferably extruded from plastic, but can be made of a variety of materials, as will be recognized by those of skill in the art. Other modifications within the scope of the appended claims will be apparent to those of skill in the art.

I claim:

1. An architectural tile comprising a panel having a top surface and a bottom surface, first attachment means extending from said top surface for engaging and attaching said panel to a first laterally adjacent panel wherein said first attachment means is spaced from an end of said panel to permit a first longitudinally adjacent panel to longitudinally overlap said panel.

2. An architectural tile according to claim 1 wherein said panel further comprises second attachment means for attaching said panel to a second laterally adjacent panel.

3. An architectural tile according to claim 2 wherein said second attachment means is spaced from an end of said panel to facilitate overlapping a second longitudinally adjacent panel.

4. An architectural tile according to claim 1 wherein said panel comprises a generally flat portion for being secured to a base.

5. An architectural tile according to claim 4 wherein said generally flat portion extends longitudinally along one side of said panel.

6. An architectural tile according to claim 5 wherein said panel further comprises a curved portion laterally adjacent said generally flat portion.

7. An architectural tile according to claim 6 wherein said panel further comprises second attachment means for attaching said panel to a second laterally adjacent panel, said curved portion including said second attachment means.

8. An architectural tile according to claim 1 wherein said panel comprises a first portion having a contour and further comprising said first longitudinally adjacent panel including a first portion having a contour, said contour of said first portion of said panel and said contour of said first portion of said first longitudinally adjacent panel being such that said first portion of said panel is in contact with said first portion of said longitudinally adjacent panel in an area of longitudinal overlap.

9. An architectural tile comprising a panel having a top surface, a bottom surface, and first and second laterally adjacent portions, first attachment means extending from said top surface of said first portion for engaging and attaching said panel to a second laterally adjacent portion of a first laterally adjacent panel wherein said first attachment means is spaced from an end of said first laterally adjacent portion of said panel to permit a first laterally adjacent portion of a longitudinally adjacent panel to longitudinally overlap said panel and to engage said top surface of said first laterally adjacent panel in a region of overlap.

10. An architectural tile according to claim 9 wherein said first attachment means comprises an elongate element which is hook-shaped in transverse cross section.

11. An architectural tile according to claim 10 wherein said first attachment means comprises at least one inwardly directed projection.

12. An architectural tile according to claim 11 wherein said at least one inwardly directed projection comprises two projections.

13. An architectural tile according to claim 10 wherein said second laterally adjacent portion comprises second attachment means for engaging a first attachment means of a laterally adjacent panel.

14. An architectural tile according to claim 13 wherein said second attachment means comprises projections for engaging said at least one inwardly directed projection of said first attachment means.

15. An architectural tile according to claim 9 wherein said second laterally adjacent portion comprises support means for extending between said bottom surface of said second laterally adjacent portion and said base to which said panel is attached.

16. An architectural tile according to claim 15 wherein said support means is secured to said bottom surface of said second laterally adjacent portion by guides, the longitudinal termination of said support means is spaced from the longitudinal termination of said guides, and a portion of said guides engages the top surface of a second laterally adjacent portion of said longitudinally adjacent tile in said region of overlap.

* * * * *